US005425656A

United States Patent [19]

Wakata

[11] Patent Number: 5,425,656

[45] Date of Patent: Jun. 20, 1995

[54] ELECTRICAL CONNECTOR ASSEMBLY

[75] Inventor: Shigekazu Wakata, Yokkaichi, Japan

[73] Assignee: Sumitomo Wiring Systems, Ltd., Mie, Japan

[21] Appl. No.: 159,547

[22] Filed: Dec. 1, 1993

[30] Foreign Application Priority Data

Dec. 2, 1992 [JP] Japan ..... 4-089717 U

[51] Int. Cl.[6] ..... H01R 13/40

[52] U.S. Cl. ..... 439/595; 439/598; 439/744

[58] Field of Search ..... 439/594, 595, 597, 598, 439/744, 745, 752, 603

[56] References Cited

U.S. PATENT DOCUMENTS

| | | | |
|---|---|---|---|
| 4,557,542 | 12/1985 | Coller et al. | 439/595 |
| 4,944,695 | 7/1990 | Tsuji et al. | 439/595 |
| 4,944,696 | 7/1990 | Sueyoshi et al. | 439/595 |
| 5,088,938 | 2/1992 | Murakami et al. | 439/595 |
| 5,256,083 | 10/1993 | Yamamoto | 439/595 |

FOREIGN PATENT DOCUMENTS

| | | |
|---|---|---|
| 0374455 | 6/1990 | European Pat. Off. . |
| 0492589 | 7/1992 | European Pat. Off. . |

*Primary Examiner*—Larry I. Schwartz
*Assistant Examiner*—Hien D. Vu
*Attorney, Agent, or Firm*—Wenderoth, Lind & Ponack

[57] ABSTRACT

The connector assembly includes a housing having a latch, a terminal to be inserted in the housing and fixed thereto by the latch, and a retainer insertable into the housing to a regular latching position at which the retainer locks the latch in position to maintain the fixing of the terminal to the housing with the latch. The retainer has a catch which will be contacted by the terminal if the retainer is in the regular latching position prior to insertion of the terminal into the housing. In this case, insertion of the terminal into the housing pushes the retainer from the regular latching position to free the latch and allow the terminal to be engaged and held by the latch.

3 Claims, 5 Drawing Sheets

ELECTRICAL CONNECTOR ASSEMBLY

BACKGROUND OF THE INVENTION

1. Field of the Invention

The present invention relates to a connector adapted to hold a terminal within a terminal accommodating chamber once the terminal has been inserted therein, and more particularly to a connector having a retainer capable of preventing the terminal from being withdrawn from the housing, the retainer being inserted forwardly into the housing after the terminal has been inserted into the rear of the terminal accommodating chamber.

2. Description of the Related Art

FIGS. 8 and 9 are cross-sectional views of a conventional connector, respectively.

A housing 1 has a cylindrical terminal accommodating chamber 3 capable of accommodating a terminal 2 when it is inserted from the rear of the housing 1 into the chamber 3. An arm 4 is formed on the bottom portion of the terminal accommodating chamber 3, adjacent to the forward portion of the housing. The arm extends toward the end of the terminal accommodating chamber 3 and is capable of extending upwardly and being bent downwardly. A latching projection 5 is formed on the upper portion of the arm 4. A latching hole 6, complementary to the latching projection 5, is formed in the terminal 2. The terminal 2 is latched to the housing 1 when the latching projection 5 is inserted in the latching hole 6.

In the forward portion of the housing 1, there is formed a retainer receiving cavity 7 which communicates with an aperture formed under the arm 4. A plate-like retainer 8 is inserted into the retainer receiving cavity 7, and the front of the retainer 8 is inserted into the aperture formed under the arm 4, thereby fixing the latch to the terminal. In addition, a convex-concave latching structure (not shown) is defined by the retainer 8 and the housing 1 within the terminal accommodating chamber 3. Thus, when the retainer 8 is inserted into the retainer receiving cavity 7, the retainer can be first latched in a temporary latching position where the front of the retainer 8 does not reach the aperture formed under the arm 4, and then can be latched in a regular latching position where the front is inserted into the aperture formed under the arm 4.

In the above structure, the retainer 8 is inserted into the retainer receiving cavity 7 formed in the forward portion of the housing 1, and initially held in the temporary latching position. In this situation, when the terminal 2 is inserted into the terminal accommodating chamber 3 from the rear end of the housing 1, the front of the terminal 2 initially contacts the latching projection 5 formed at the end of the arm 4. However, since the aperture formed under the arm 4 is open, the arm 4 can be bent downwardly, whereby the terminal 2 can be inserted up to the end of the terminal accommodating chamber while depressing latching projection 5 and the arm 4. When the terminal is inserted up to the end of the terminal accommodating chamber 3, the latching hole 6 of the terminal 2 faces the upper portion of the latching projection 5, and the latching projection 5 is inserted into the latching hole 6 by a restitutive force, thereby causing the terminal 2 to be firmly held in that position.

Further, when the retainer 8 is inserted to the regular latching position, the front of the retainer 8 is inserted into the aperture formed under the arm 4 and latched, thereby preventing the arm 4 from being bent downwardly. In this situation, since the latching projection 5 cannot be withdrawn from the latching hole 6 of the terminal 2, the terminal 2 cannot be withdrawn from the terminal accommodating chamber 3.

In addition, if the terminal 2 is only inserted halfway into the chamber 3, the arm 4 is depressed by the terminal 2, bent downwardly and held in that position, whereby the aperture for receiving the front of the retainer 8 is closed. Accordingly, the retainer 8 cannot be inserted, and thus it is possible to detect the halfway insertion of the terminal.

On the other hand, with this kind of connector, connectors in which the retainer 8 is held in the temporary latching position are often packed in a packing box or packing bag and conveyed to a station where the next terminal insertion step is carried out. If some outer force is applied to the retainer 8 during the conveyance, the retainer may be mistakenly moved to the regular latching position. In the regular latching position, the terminal 2 cannot be inserted since the arm 4 cannot be bent. In this situation, in order to properly insert the terminal 2, first, a tool is used to push back the retainer 8 to the temporary latching position, and then the terminal 2 can be fully inserted.

SUMMARY OF THE INVENTION

The present invention was made in view of the above problems, and has as its object to provide a connector capable of facilitating its assembly when the retainer has been inserted and held in the regular latching position before the terminal is inserted.

To achieve the above object, the present invention provides a connector comprising a housing having a terminal insertion cavity therein, the housing retaining a terminal therein when the terminal is inserted into the terminal insertion cavity from the rear end of the housing, a retainer adapted to prevent the terminal from being withdrawn when the retainer is inserted from the forward end of the housing, and means for ensuring that the retainer is in a prescribed temporary latching position while the terminal is being inserted.

According to the present invention having the above features, when the retainer has been inserted in the housing to a regular latching position before the terminal is inserted, means are provided to push the retainer back to a temporary latching position while the terminal is being inserted into the terminal insertion cavity from the rear end of the housing. Therefore, regardless of whether the retainer is located in the regular latching position before the insertion of the terminal, the terminal can be properly inserted to the fully inserted position thereof without being interfered with by the retainer.

The retainer is capable of being inserted from the forward end of the housing and held by the housing in the temporary latching position where insertion of the terminal is not prevented, and is capable of being held by the housing in the regular latching position to prevent the terminal from being withdrawn.

In the connector having the above features, in a normal situation, the retainer is inserted to the temporary latching position where the insertion of the terminal is not prevented. If the retainer is mistakenly further inserted from the temporary latching position to the regular latching position, the retainer is pushed back to the temporary latching position during the insertion of the terminal. Since the retainer is pushed back only to the temporary latching position, it is only necessary to reinsert the retainer from the temporary latching position to the regular latching position.

The housing has a latch to retain the terminal in its fully inserted position. The latch is a resilient arm having a latching projection. The arm is extendable and retractable and the latching projection latches onto the terminal located within the terminal insertion cavity when the arm is in an extended position. The retainer is adapted to permit the latching projection to be depressed (retracting the arm) when located in the temporary latching position and is adapted to prevent the latching projection from being retracted when located in the regular latching position.

In the conventional connector, when the retainer is in the regular latching position, the latching projection cannot be depressed and the arm is extended within the terminal insertion cavity. Thus, in this case, the terminal cannot be inserted. However, according to the present invention having the above features, since the retainer is pushed back to the temporary latching position by pushing means during the insertion of the terminal, the latching projection can be depressed to permit the full insertion of the terminal.

The pushing means comprises a catch in the form of a flexible protrusion extending from the retainer. An evacuation space for accommodating the protrusion is formed within the housing.

In the connector having the above features, the flexible protrusion extends from the retainer toward the terminal insertion cavity. Thus, during the insertion of the terminal into the terminal insertion cavity, the terminal contacts the flexible protrusion, pushes the retainer back to the temporary latching position, and is finally latched with the latching projection. Thereafter, when the retainer is reinserted to the regular latching position, the flexible protrusion first contacts the terminal and tends to push it out of the housing in an opposite direction. However, since the terminal is latched with the latching projection and is firmly held, the terminal cannot be pushed out of the housing. Instead, the flexible protrusion is bent into the evacuation space.

Further, in the present invention, the flexible protrusion may be in the form of a thin flat plate. In this case, when the retainer which has been pushed back is reinserted, the flexible protrusion is readily bent because of its shape. Thus, the flexible protrusion can be readily deflected by the terminal into the evacuation space, thereby permitting easy reinsertion of the retainer.

Further, in the present invention, the terminal may have a protruding plate-like stabilizer as the pushing means.

BRIEF DESCRIPTION OF THE DRAWINGS

The foregoing, and additional objects, features, and advantages of the present invention will become apparent from the following description of the preferred embodiments thereof, taken in conjunction with the following drawings, in which.

DETAILED DESCRIPTION OF THE PREFERRED EMBODIMENTS

With reference to FIGS. 1 to 7, one of the embodiments of the present invention will be described in detail.

Figure 1:
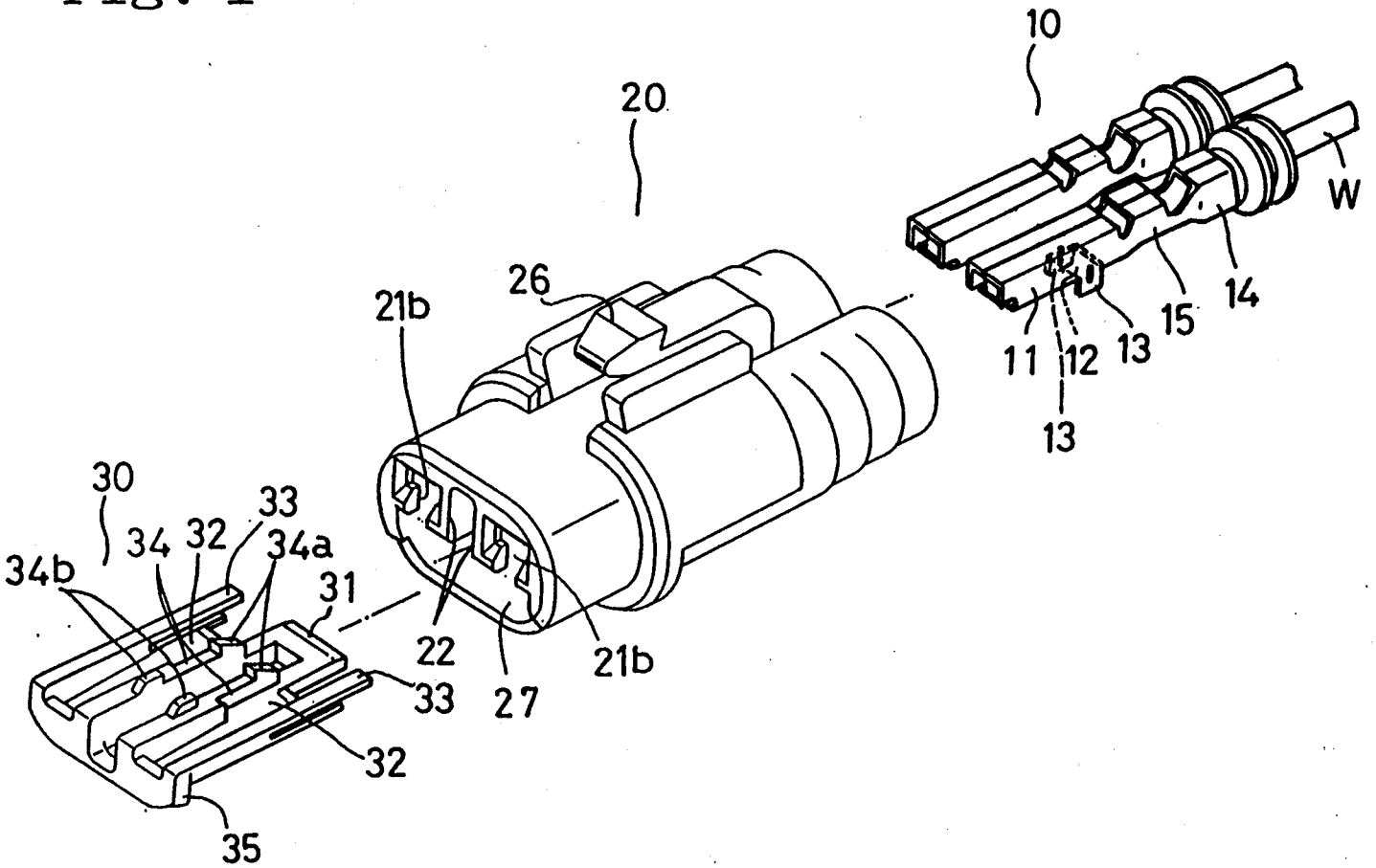
FIG. 1 is an exploded perspective view of a connector assembly according to the present invention.

As shown in FIG. 1, a connector comprises a housing 20 adapted to accommodate and hold a terminal 10, and a retainer 30 discrete from the housing 20.

The terminal 10 has tubular contact members 11 formed in the front portion thereof and having a square cross section, the contact members 11 being adapted to receive a male terminal (not shown). Each of the contact members 11 has a latch receiving portion defining a latching hole 12 in the middle of the lower surface of the terminal, the hole 6 extending in an axial direction of the contact member. In this embodiment, the latching hole 12 is formed by cutting the lower surface of the contact member 11 in U-shapes so as to leave U-shaped portions of the lower surface, and bending the U-shaped portions downwardly to raise them from the lower surface. The bent and raised portions form flat plate-shaped stabilizers 13 protruding downwardly from the same lower surface on both sides of the terminal. Further, the terminal 10 has, in the rear portion thereof, an insulation barrel 14 adapted to grip a coated portion of electric wires, and a wire barrel 15 adapted to grip a conductive portion of the electric wires where core wires are exposed.

Figure 2:
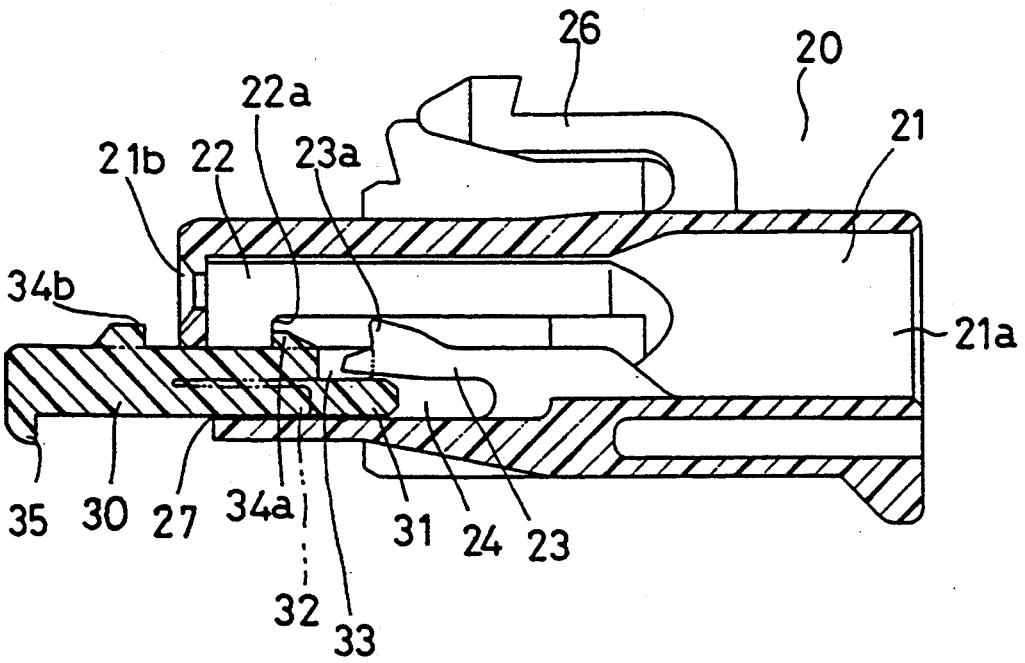
FIG. 2 is a cross-sectional view of the housing of the connector assembly.
Figure 3:
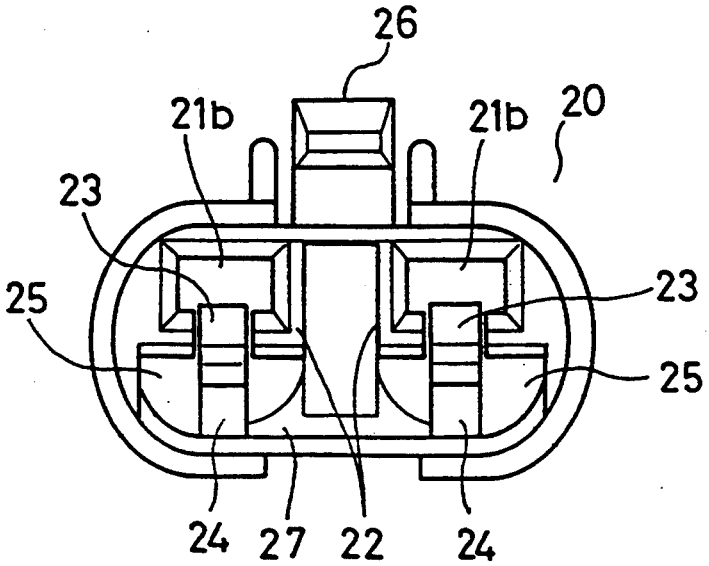
FIG. 3 is a front view of the housing.

As shown in FIGS. 2 and 3, the housing 20 has two terminal accommodating chambers 21 adapted to accommodate the terminal 10 from the rear of the housing, which chambers 21 are formed in a parallel and substantially symmetrical arrangement with respect to the widthwise direction of the housing 20. Each of the terminal accommodating chambers 21 includes an insertion cavity **21*a* for receiving the terminal 10 and formed in the rear portion of the housing 20, and an insertion cavity 21*b* for receiving a female terminal (not shown) and formed in the forward portion of the housing 20. In addition, dividing walls 22 are formed in a parallel arrangement in the forward portion of each of the terminal accommodating chambers 21**.

A movable latch in the form of a pair of arms 23, capable of being extended upwardly and being bent (retracted) downwardly, protrude upwardly from the middle, in both longitudinal and transverse directions, of the terminal accommodating chambers 21, and extend forwardly. Each latching arm 23 is narrower than the width of the terminal 10, and its upper surface is substantially flat so that the terminal 10 can be inserted between the upper surface of the latching arm 23 and the surface of the housing defining the top of the terminal accommodating chamber 21. A latching projection **23*a*, capable of being inserted into a latching hole 12, protrudes from the upper surface of the front of each of the latching arms 23. An aperture 24 is formed between the front of each latching arm 23 and a surface of the housing 20 defining the bottom of each terminal accommodating chamber 21. Further, an evacuation space 25 is also formed between each of the latching arms 23 and an inner wall surface of the housing. In addition, a connector engaging member 26 protrudes from an upper portion of the outer surface of the housing 20**, and can be tightly inserted into a corresponding connector (not shown) to be locked therewith.

A retainer receiving cavity 27, capable of receiving a retainer 30, is formed contiguously to the terminal accommodating chamber 21 in the lower front portion of the housing 20, which lower portion is beneath the insertion cavities 21*b*. The retainer 30 has a substantially plate-like shape and is capable of being inserted into the retainer receiving cavity 27. A front portion 31 of the retainer 30 is narrow so that it can be inserted into the aperture formed between both latching arms 23. Wide locking portions 32, formed at both sides of the retainer, and located a little rearward of the front portion 31, are insertable into the apertures 24 formed under latching arms 23 to be latched therewith. In addition, a catch, whose function will be described later, comprises flexible elongate protrusions 33 of the retainer 30 formed outwardly of the locking portions 32. The thin flat plates constituting the elongate protrusions 33 will face the outer sides of the plate-shaped stabilizers 13, respectively, when the terminal 10 is inserted, and their length is about the same as that of the front portion 31 of the retainer.

In addition, housing engaging portions 34 in the form of convex projections 34*a*, 34*b* are formed in the middle of the retainer with respect to the width thereof. The projections 34*a* are to face the lower surface of the dividing walls 22 and are aligned in the insertion direction with the projections 34*b*. The dividing walls 22 in turn have a retainer engaging portion in the form of concave portions 22a which are engageable with the convex projections 34*a*, 34*b*. When the engaging projections 34*a* are engaged with the concave portions 22*a*, the locking portions 32 are not received in the apertures 24 formed under the latching arms 23. When the other engaging projections 34*b* are engaged with the concave portions 22*a*, the locking portions 32 are located within the apertures 24 formed under the latching arms 23. Further, a stopper 35 is formed at the rear end of the retainer 30. The stopper 35 will contact the front of the housing adjacent to the retainer receiving cavity 27 when the retainer 30 is inserted.

Next, the function of the above embodiment of the present invention will be described below.

First, the retainer 30 is inserted into the retainer receiving cavity 27 of the housing 20 with the front portion 31 leading the retainer into retainer receiving cavity 27. As the retainer 30 is inserted, the retainer engaging portions 34 are advanced under the dividing walls 22, and the retainer 30 is temporarily latched to the housing 20 when the convex projections 34*a* are engaged with the concave portions 22*a*. At this stage, as shown in FIG. 2, the locking portions 32 have not been inserted into the apertures formed under the latching arms 23, and the front portions of the latching arms 23 can be bent downwardly. The position of the retainer 30 in this situation will be referred to as the "temporary latching position".

Next, the terminal 10 is inserted into the terminal accommodating chambers 21, with the contact members 11 facing the insertion cavities 21*a*. At this stage, the contact members 11 are advanced while slidably contacting the upper surface of the latching arms 23. When the front portions of the contact members 11 contact the latching projections 23*a*, the front portions depress the latching projections 23*a* to bend the latching arms 23 downwardly.

Further, when the terminal 10 is further inserted and just before the front of the terminal 10 contacts the front end of the housing 22, the latching holes 12 formed in the lower surface of the contact members 11 receive the latching projections 23*a*. Thus, the latching arms 23 are restored to their initial positions with the latching projections 23*a* being inserted into the latching holes 12, whereby the terminal 10 is latched to the housing 20 in a fully inserted position. In addition, while the contact members 11 are being slid along the upper surface of the latching arms 23, the latching arms 23 are held between the stabilizers 13 so that the terminal 10 can be inserted without being swung in a right- or left-hand direction.

Figure 4:
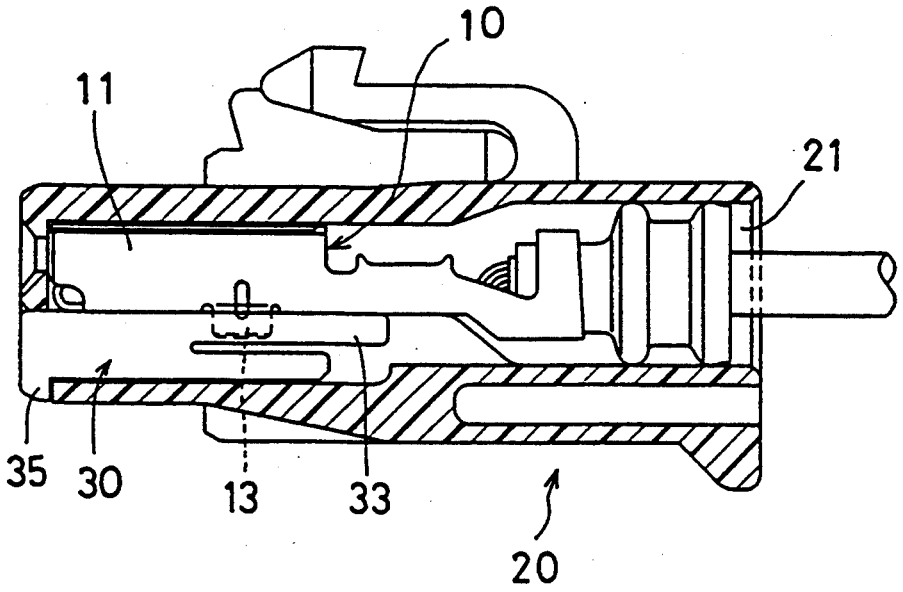
FIG. 4 is a cross-sectional view of the connector assembly in which the retainer is located in the regular latching position.
Figure 5:
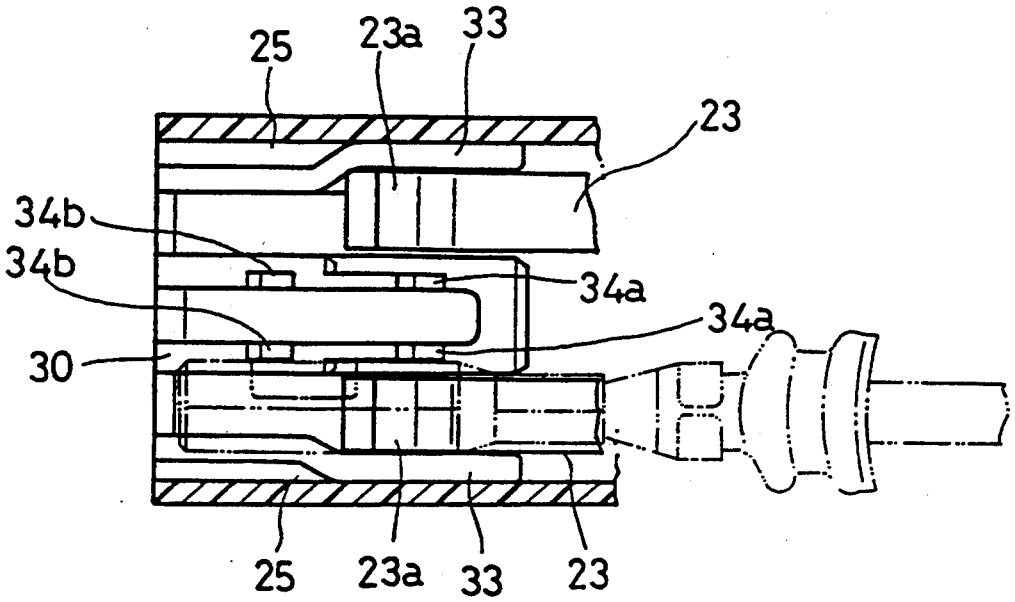
FIG. 5 is a partial cross-sectional view of the connector assembly showing the regular latching position of the retainer.
Figure 6:
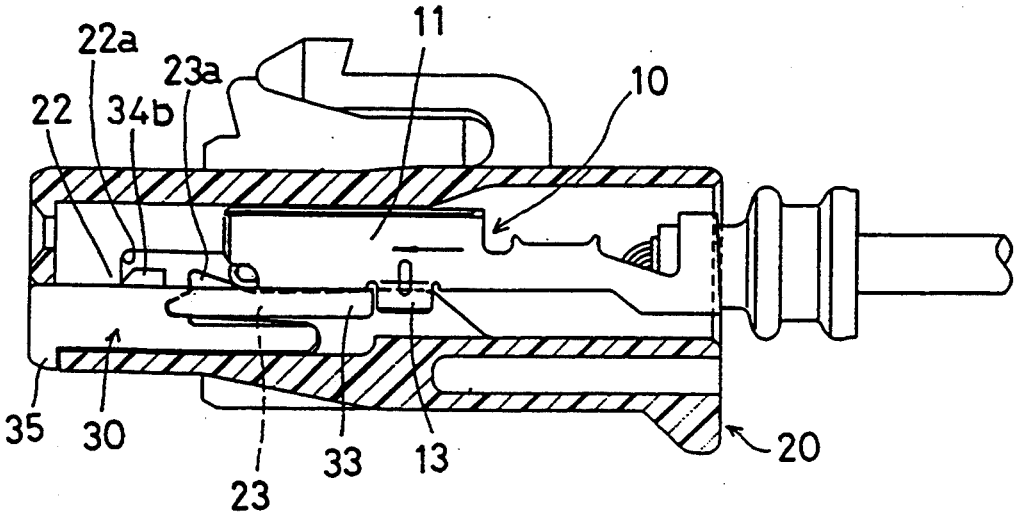
FIG. 6 is a cross-sectional view of the connector assembly showing the terminal inserted halfway in the terminal insertion cavity.
Figure 7:
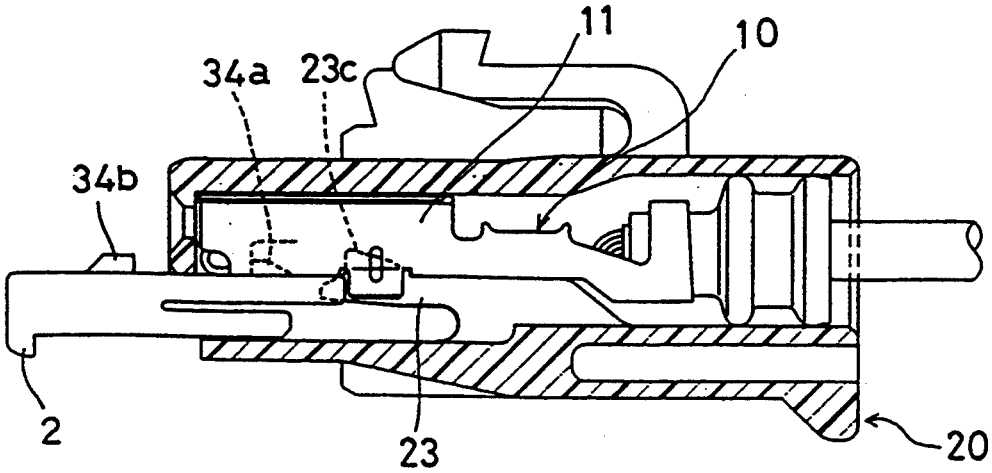
FIG. 7 is a cross-sectional view of the connector showing the retainer having been pushed back from the position shown in FIG. 6.
Figure 8:
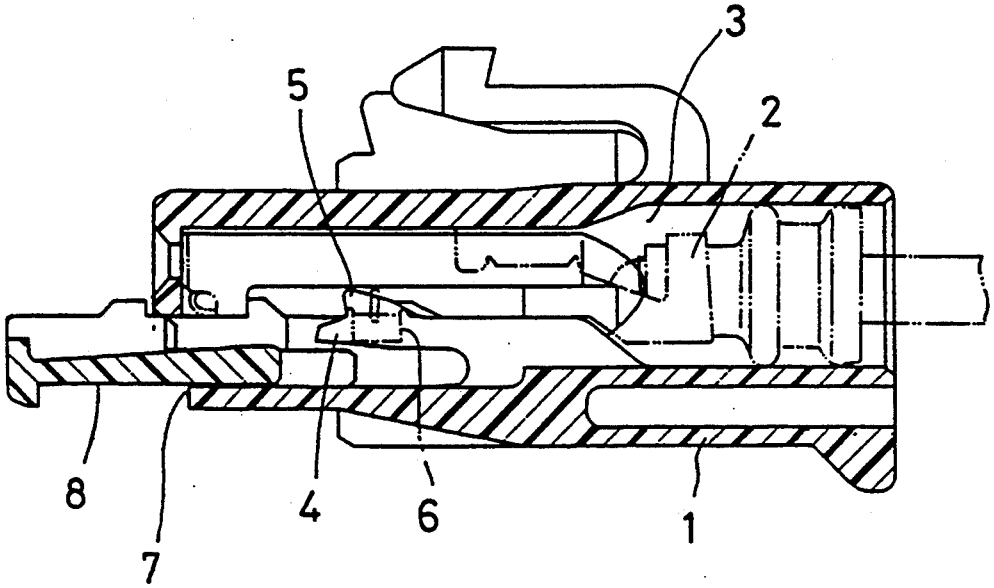
Fig. 8 PRIOR ART
FIG. 8 is a cross-sectional view of a conventional connector.
Figure 9:
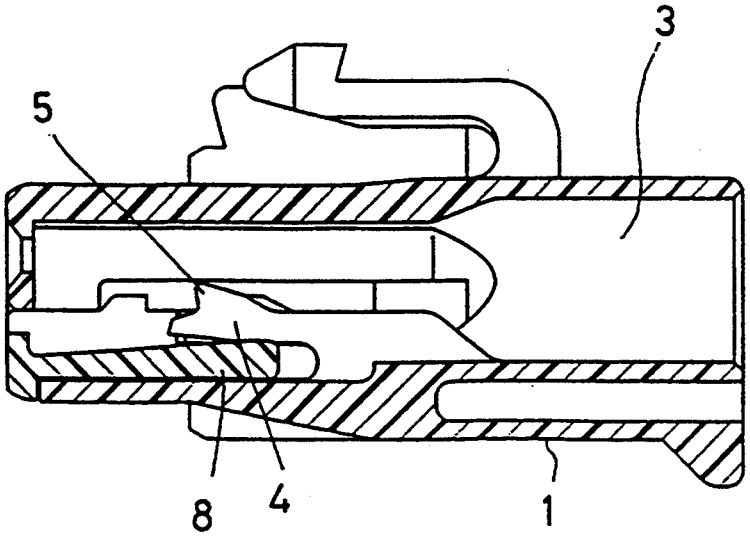
Fig. 9 PRIOR ART
FIG. 9 is another cross-sectional view of the conventional connector.

After the terminal 10 is fully inserted, the retainer 30 is further inserted into the retainer receiving cavity 27. In the beginning of this step, the front portions of the elongate protrusions 33 contact the stabilizers 13 which slidably grip the latching arms 23, and try to push the terminal 10 out. However, the terminal 10 is held by the latching projections 23*a* and thus cannot be moved rearwardly. Also, since the elongate protrusions 33 are in the form of thin plates, the elongate protrusions 33 are bent into the vacant spaces 25 away from the stabilizers 13. Thus, as shown in FIGS. 4 and 5, the retainer 30 can be inserted until the stopper 35 contacts the front of the housing 20 adjacent to retainer receiving cavity 27. FIG. 5 shows the elongate protrusions 33 bent into the spaces 25.

At this stage, since the locking portions 32 are inserted into the apertures 24 formed under the latching arms 23, the latching arms 23 cannot be bent downwardly. When the latching arms 23 cannot be bent downwardly, the latching projections 23*a* cannot be removed from the latching holes 12 of the terminal 10. Thus, the withdrawal of the terminal 10 is prevented. In addition, the engaging projections 34*b* are engaged with the concave portions 22*a* forming the bottom of the dividing walls 22, whereby the withdrawal of the retainer 30 itself can be prevented. The position of the retainer 30 in this situation will be referred to as the "regular latching position".

Next, assume that the retainer has been mistakenly moved from the temporary latching position to the regular latching position for some reason before the terminal has been inserted. As mentioned above, in this situation, according to the conventional structure, the locking portions of the retainer are in the apertures formed under the latching arms, thereby preventing the latching arms from being bent downwardly. Therefore, the latching projections prevent the insertion of the terminal.

However, in this case, the stabilizers 13 serve as a retainer contacting portion of the terminal 10 to push the retainer 30 from the regular latching position back to the temporary latching position.

More specifically, according to the present invention, while the terminal 10 is being inserted, the pairs of stabilizers 13 are advanced within the spacers 25 while sliding along both sides of the latching arms 23. Then, before the front of the terminal 10 contacts the latching projections 23*a*, the stabilizers 13 contact the front of the elongate protrusions 33 of the retainer 30 which are located in the spacers 25 (refer to FIG. 6). The protrusions 33 serves as a catch, engaged by the stabilizers 13, so that when the terminal 10 is further inserted, the terminal 10 pushes the retainer 30 while in contact with the elongate protrusions 33. Therefore, the locking portions 32 of the retainer 30 are moved out of the apertures 24 formed under the latching arms 23. Around this time, the front of the terminal 10 contacts the latching projections 23*a*, and the terminal 10 bends the latching arms 23 downwardly (refer to FIG. 7). The terminal 10 is latched with the latching projections 23*a* being received in the latching holes 12. Thereafter, the retainer can be reinserted. The stabilizers 13 thus constitute a retainer contacting portion of the terminal which serves to contact and push the terminal from the regular latching position in the above-described situation, in addition to stably guiding the terminal during its insertion.

In addition, when the terminal 10 is held in the fully inserted position and the retainer 30 is inserted, the elongate protrusions 33 are bent and exert a strong retention force which holds the terminal 10. On the other hand, as is clear from the above, when the terminal 10 is inserted and contacts the elongate protrusions 33, the retainer 30 is held only by the engaging projections 34*b*. Therefore, the retainer can be pushed out without the elongate protrusions 33 being bent.

In other words, regardless of whether the retainer 30 is in the temporary or regular latching position, the terminal insertion operation can be conducted in only two steps, i.e., the terminal 10 is first inserted into the housing 20, and then the retainer 30 is pushed in.

In addition, in the above-described embodiment of the present invention, the retainer is pushed back by bringing the stabilizers 13 into contact with the elongate protrusions 33; however, the present invention is not limited to the above embodiment, and contemplates any variations or modifications thereof in which the terminal 10 contacts the retainer 30 (in the regular latching position) in the midst of its insertion to push back the retainer to the temporary latching position.

What is claimed is:

1. An electrical connector assembly comprising:

a housing having a forward end and a rear end, said housing defining a terminal insertion cavity open at the rear end thereof and a retainer receiving cavity open at the forward end thereof, and said housing having a movable latch associated with said terminal insertion cavity;

a terminal insertable into said terminal insertion cavity of the housing from said rear end of the housing, said terminal having a latch receiving portion which engages said latch of the housing when the terminal is in a fully inserted position in said terminal insertion cavity, and said terminal having a retainer contacting portion, the engagement between said latch of the housing and the latch receiving portion of said terminal preventing said terminal from being pulled out of said housing from said rear end thereof; and a retainer insertable into said retainer receiving cavity of the housing from said front end of the housing, said retainer having a locking portion engageable with said movable latch when said retainer is in a regular latching position in said retainer receiving cavity, the engagement of said locking portion with said movable latch fixing said latch in position to maintain the engagement between said latch and the latch receiving portion of said terminal when the terminal is in the fully inserted position thereof, and said retainer having a catch which will be contacted by the retainer contacting portion of said terminal when said retainer is in said regular latching position thereof as said terminal is being inserted into said terminal insertion cavity such that said retainer will be moved by said terminal from said regular latching position thereof thereby freeing said latch for engagement with the latch receiving portion of said terminal;

said housing also having a retainer engaging portion associated with said retainer receiving cavity, and said retainer also having housing engaging portions sequentially engageable with said retainer engaging portion of the housing as the retainer is inserted into said retainer receiving cavity to hold said retainer in a temporary latching position and in said regular latching position, respectively, the locking portion of said retainer being out of engagement with said latch when the retainer is in said temporary latching position, and said terminal moving said retainer from said regular latching position to said temporary latching position by contact between said retainer contacting portion of said terminal and the catch of said retainer when said terminal is inserted into said terminal insertion cavity while said retainer is located in said regular latching position;

said movable latch comprising an extendable and retractable arm, said arm being in an extended position when engaging the latch receiving portion of said terminal disposed in the fully inserted position thereof, and said locking portion of the retainer preventing said arm from retracting when said retainer is in said regular latching position; and said housing defining an evacuation space contiguous to said retainer receiving cavity, and said catch of the retainer comprising a flexible protrusion, said flexible protrusion being bent into said evacuation space by said retainer contacting portion of the terminal when said retainer is inserted to said regular latching position thereof while said terminal is in said fully inserted position thereof.

2. An electrical connector assembly according to claim 1, wherein said flexible protrusion has the shape of a thin flat plate.

3. An electrical connector assembly according to claim 2, wherein said arm has a flat surface, and the retainer contacting portion of said terminal comprises a flat plate-shaped member which slidably engages the flat surface of said arm as said terminal is inserted into said terminal insertion cavity.

* * * * *